US006228450B1

(12) United States Patent
Pedrini

(10) Patent No.: US 6,228,450 B1
(45) Date of Patent: May 8, 2001

(54) LABEL FOR RE-CLOSABLE PACKAGING

(75) Inventor: Maurizio Pedrini, Parma (IT)

(73) Assignee: Barilla G. e R. F. lli, Parma (IT)

( * ) Notice: Subject to any disclaimer, the term of this patent is extended or adjusted under 35 U.S.C. 154(b) by 0 days.

(21) Appl. No.: 08/931,224

(22) Filed: Sep. 16, 1997

Related U.S. Application Data

(62) Division of application No. 08/492,508, filed on Jun. 20, 1995, now abandoned.

(30) Foreign Application Priority Data

Jul. 4, 1994 (IT) ..... MI94A1394

(51) Int. Cl.[7] ..... B65D 65/32

(52) U.S. Cl. ..... 428/40.1; 40/299; 40/306; 40/310; 229/238; 229/309; 229/924; 283/81; 428/41.4; 428/42.1; 428/42.2; 428/192; 428/194

(58) Field of Search ..... 428/40.1, 42.1, 428/42.2, 43, 192, 194, 131, 41.8, 41.4; 40/299, 306, 310; 229/238, 309, 924; 283/81

(56) References Cited

U.S. PATENT DOCUMENTS

| | | | | |
|---|---|---|---|---|
| 4,151,319 | * | 4/1979 | Sackoff | 428/41.4 |
| 4,323,608 | * | 4/1982 | Denny | 428/43 |
| 4,479,316 | * | 10/1984 | Wippern | 428/42 |
| 4,940,690 | * | 7/1990 | Skees | 428/41.8 |
| 5,029,712 | * | 7/1991 | O'Brien | 206/621 |
| 5,040,685 | * | 8/1991 | Focke | 206/607 |
| 5,106,124 | * | 4/1992 | Volkman | 428/41.8 |
| 5,219,183 | * | 6/1993 | McKillip | 428/41.8 |
| 5,307,988 | * | 5/1994 | Focke | 229/238 |

* cited by examiner

*Primary Examiner*—Nasser Ahmad
(74) *Attorney, Agent, or Firm*—Steinberg & Raskin, P.C.

(57) ABSTRACT

A label (6) for re-closable packages (1) has an application side (8) on which a layer of self-adhesive glue (20) is spread for application to a surface (7) of a re-closable package (1) to achieve a predetermined adhesive strength. The application side (8) is siliconized in a manner such that the adhesive strength between the side (8) and the layer of self-adhesive glue (20) is less than the predetermined strength. After application, the layer of glue (20) is transferred to the application surface (7), eliminating the risk of tearing of the re-closable package (1).

7 Claims, 2 Drawing Sheets

LABEL FOR RE-CLOSABLE PACKAGING

This is a Divisional of Application Ser. No. 08/492,508, filed on Jun. 20, 1995, now abandoned.

BACKGROUND OF THE INVENTION

1. Field of the Invention

The present invention relates to a label for re-closable packages, having an application side on which a layer of self-adhesive glue is spread for application to a surface of a re-closable package to achieve a predetermined adhesive strength.

More particularly, the label is of the type which is made available on a siliconized backing, for example, a continuous backing tape.

2. Description of the Prior Art

Self-adhesive labels of the type specified are used, for example, for re-closable packages for food products such as bakery products, for example, toasted bread slices, biscuits and the like, the contents of which are not eaten all at once. Until the contents are completely used up, the package therefore has to be re-closable by means of the same label, to protect the food product from air, odours, etc., in order to keep its physical and organoleptic characteristics unchanged.

The self-adhesive label is therefore intended to be detached by the consumer when the re-closable package is opened, for subsequent re-use by the consumer to reclose or seal the package.

Labels of the type specified have a considerable disadvantage, however.

The strength of the adhesion of the layer of glue to a surface depends mainly upon the physical characteristics, such as the roughness, the porosity, etc., of the surface, upon the length of time which elapses between the application and the first use, and upon the temperature at which the reclosable packages are stored.

The variability of the last two parameters mentioned, together with the type of paper which is usually used to manufacture re-closable packages for bakery products and the like, means that it is impossible to predict with certainty the adhesive strength between the layer of self-adhesive glue and the surface of the re-closable package to which it is applied.

Naturally, to prevent the packages from opening spontaneously during transportation and display for sale, self-adhesive glues which achieve good adhesive strength between the layer of glue and the package, that is, between the label and the package, tend to be used, in any case.

The satisfaction of this requirement, however, causes an undesirable number of the aforesaid labels to tear the paper surface to which they are applied during their removal from the package in order to open it, rendering further use of the label impossible and irreparably damaging the package because the layer of glue adheres tightly to the package with too great an adhesive strength.

SUMMARY OF THE INVENTION

The technical problem of the present invention is to make available a self-adhesive label which overcomes the disadvantage mentioned with reference to the prior art.

The concept by which this problem is solved consists of the provision of a label which, during use, gives up the layer of self-adhesive glue from its application side to the surface of the re-closable package.

This problem is solved by a label of the type specified, characterized in that the application side is siliconized to cause the adhesive strength between the side and the layer of self-adhesive glue to be less than the predetermined strength.

The main advantage of the self-adhesive label according to the invention consists of the release of the layer of self-adhesive glue from the application side of the label, preventing the removal of the label from resulting in tearing of the surface of the re-closable package to which it is applied.

Further characteristics and advantages of the label according to the invention will become clear from the detailed description of an embodiment given below with reference to the appended drawings, which are provided by way of non-limiting example, with reference to a re-closable package of toasted bread slices.

DESCRIPTION OF THE PREFERRED EMBODIMENT

Figure 1:
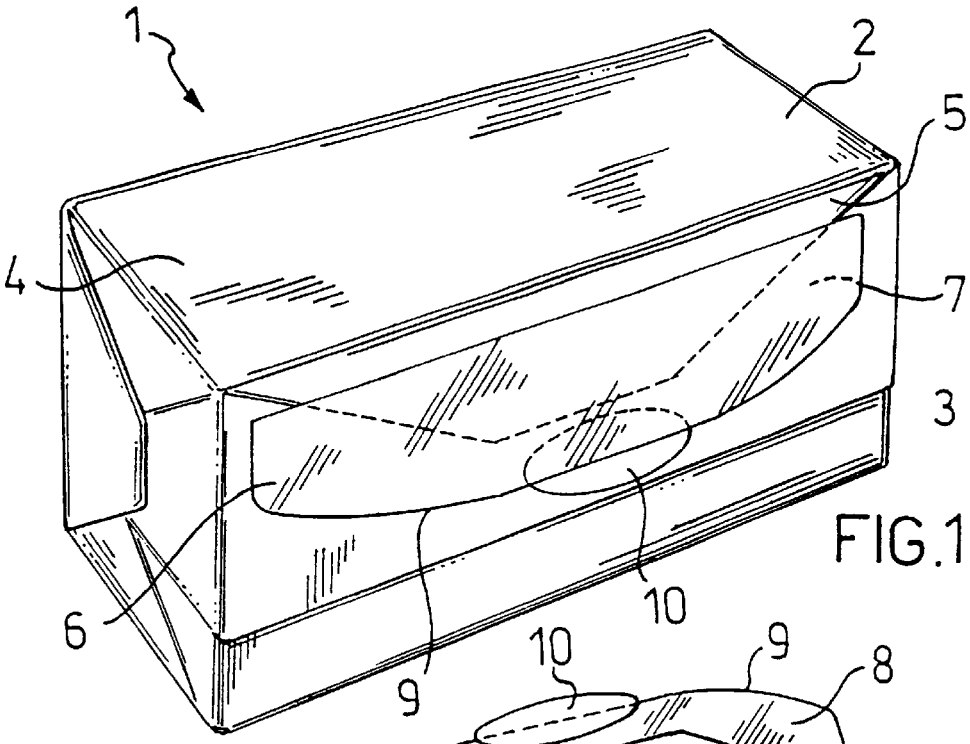
FIG. 1 is a perspective view of a closed, re-closable package having a label according to the invention.
Figure 2:
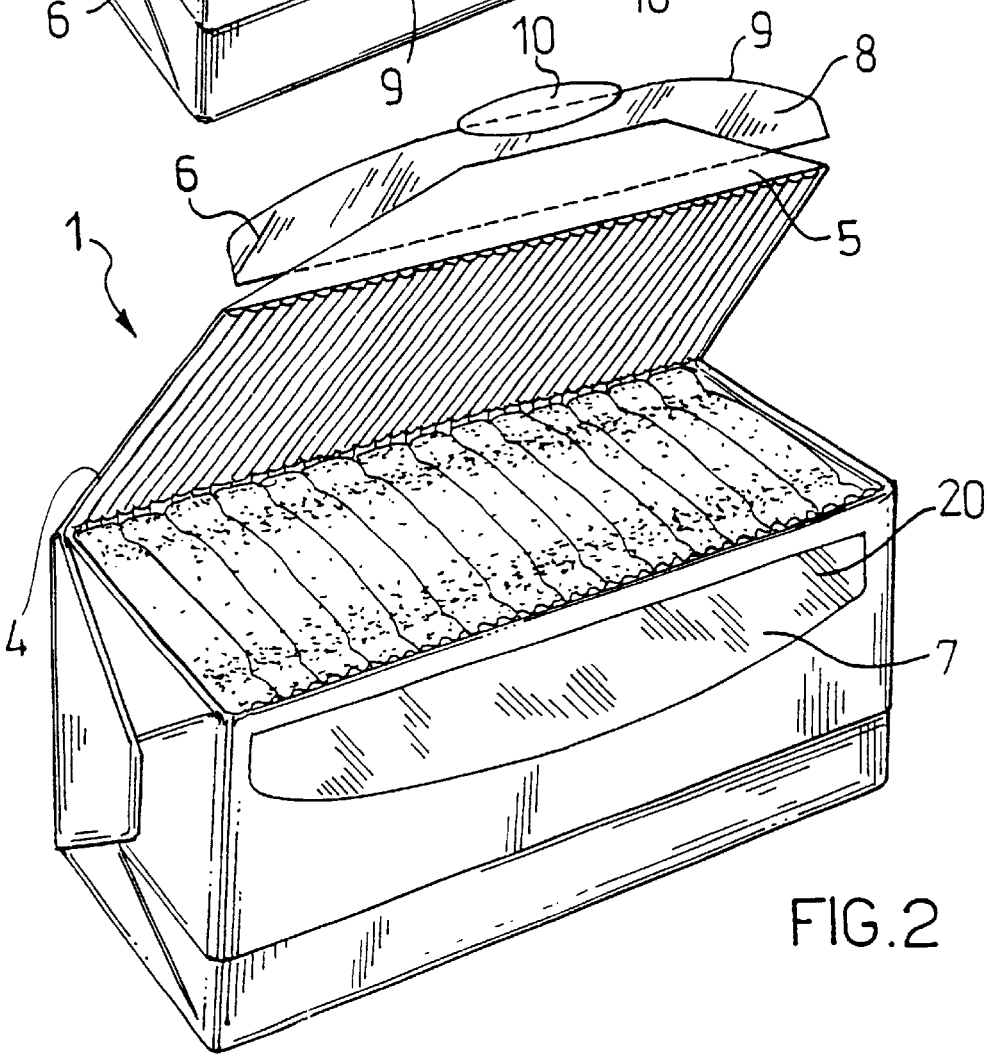
FIG. 2 is a perspective view of the package of FIG. 1 in the open condition.
Figure 3:
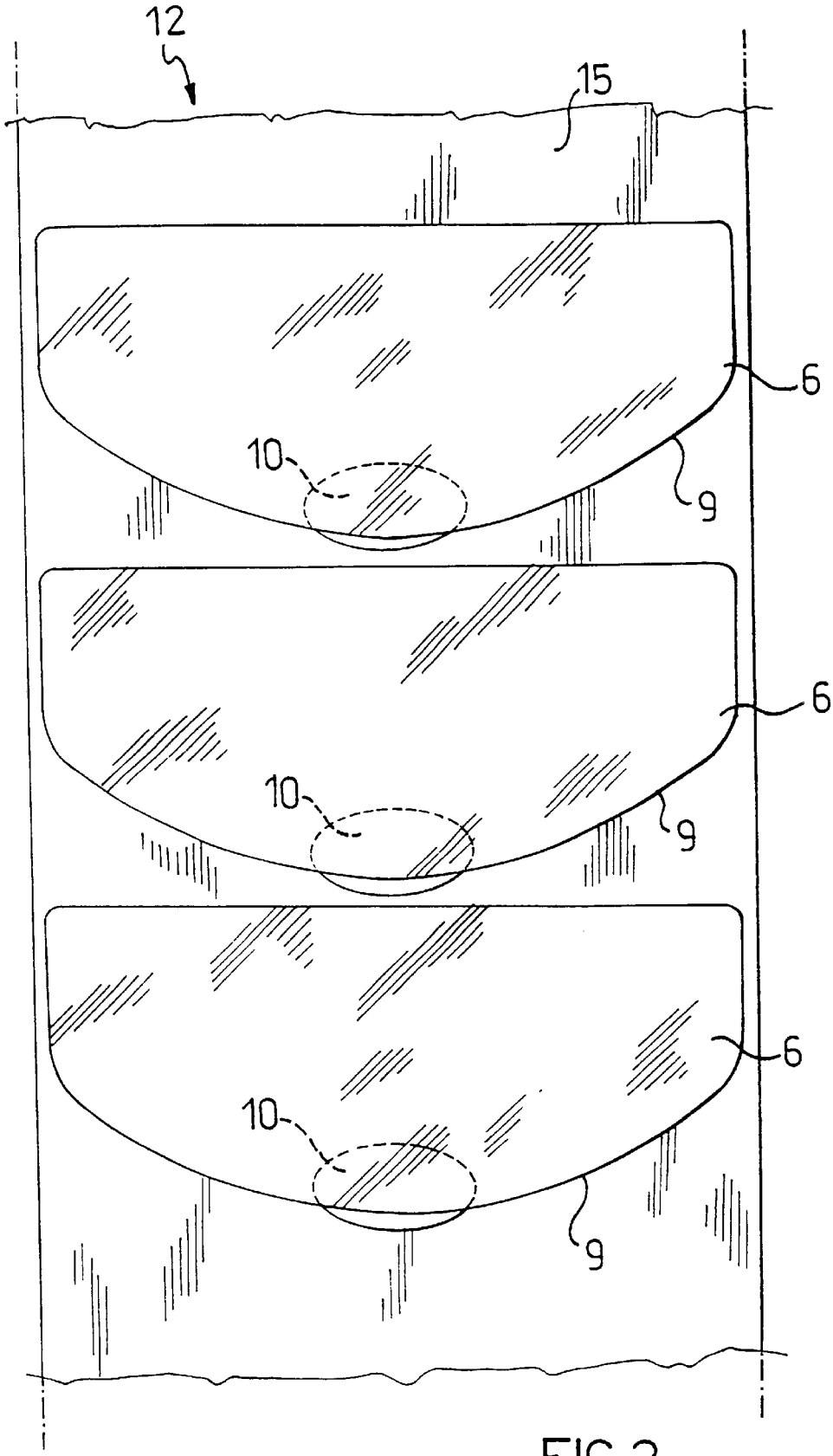
FIG. 3 is a view of a portion of the continuous substrate tape for the labels according to the invention.

With reference to FIGS. 1 and 2, a re-closable package is generally indicated 1. It has a parallelepiped shaped wrapper 2 constituted by a sheet 3 for wrapping foods, suitably cut and folded to form a closure side 4, substantially like an envelope, comprising a flap 5.

According to a preferred embodiment of the present invention, the food-wrapping sheet 3 is slightly siliconized externally to afford greater tear-resistance.

A label, generally indicated 6, which has an application side 8 and an edge 9, is superimposed on and stuck to the flap 5.

The label 6 is of the type which is mass-produced and made available on a backing constituted by a continuous backing tape 12 which can be rolled up and is formed of a paper material known as glassine, which has considerable surface siliconization to make it particularly smooth and free of pores.

The labels 6 are disposed in a continuous row on a face 15 of the tape 12 and are then detached therefrom for application to the re-closable packages 1.

According to the conventional technique, before the labels 6 are applied to the face 15 of the continuous backing tape 12, a layer of self-adhesive glue 20 is spread on the face 15 of tape 12. Since the backing tape 12 is highly siliconized, the strength of the adhesion of the layer of glue 20 to the face 15 is minimal.

After the labels 6 have been applied to the face 15 of the tape 12, the layer of glue 20 also adheres to the application sides 8 of the labels 6, the layer of glue 20 adhering to the latter with a greater adhesive strength than to the face 15.

If, advantageously, the labels 6 are made of a paper material of the type known as glassine, the application sides 8 of the labels 6 will be less siliconized than the continuous backing tape 12 to allow better adhesion of the layer of glue 20 to the application side 8.

When the label 6 is removed from the continuous backing tape 12, a layer of glue 20 extends over the application side 8 of the label 6.

When the flap 5 is folded (FIG. 1) the label 6 is intended to be applied to a surface 7 of the re-closable package 1 which is part of the food-wrapping sheet 3.

The layer of self-adhesive glue 20 is thus interposed between the application side 8 and the surface 7. Owing to the particular surface finishing of the surface 7, which is slightly siliconized, a predetermined adhesive strength is achieved between the layer of glue 20 and the surface 7 which is greater than the strength of adhesion to the application side 8.

Since the application side 8 is siliconized to a greater degree than the surface 7, the adhesive strength achieved between the layer of self-adhesive glue 20 and the application side 8 is less than the predetermined adhesive strength achieved between the layer 20 and the surface 7.

As a whole, therefore, the strength of the adhesion of the layer of glue 20 to the application side 8 of the label 6 is intermediate the minimal strength of adhesion to the face 15 of the tape 12, and the strength of adhesion to the surface of the re-closable package 1.

After the first removal, the layer of glue 20 will therefore remain adhering to the surface 7 of the package 1 whilst the application side 8 of the label 6 will be free of glue.

According to a preferred embodiment of the label 6 of the invention, a structurally independent, approximately disk-shaped tongue 10 of paper material is associated removably with the self-adhesive side 8 and is positioned on the edge 9 of the label 6 so as to cover a portion of the edge 9.

The tongue 10 preferably projects from the edge 9.

In order to open the re-closable package 1, it therefore suffices to grip the self-adhesive label 6 by the tongue 10 and pull, detaching the label 6 from the flap 5 of the closure side 4, which is free to be opened.

By virtue of the tear-resistant properties of glassine, it is possible to use a water-soluble glue, which is generally very tenacious, rather than a solvent-based glue which might have noxious effects on the food products in the re-closable packages 1.

Moreover, the entire assembly of the label 6 and the package 1 is particularly strong and can remain unchanged even after many closures and openings of the re-closable package 1.

Furthermore, the label according to the invention is cheap to produce and is suitable for mass-production.

It is intended that any other backing for self-adhesive labels, such as a siliconized card with the same outline as the label or a siliconized backing sheet for a plurality of labels disposed thereon in several rows, may be provided instead of the continuous backing tape 12 on which the labels 6 are made available.

It is intended that, in order to satisfy certain requirements of use, an expert in the art may introduce many variants of the label for re-closable packages according to the invention, all of which, however, are within the scope of protection of the invention as defined by the following claims.

What is claimed is:

1. A reclosable package comprising a sheet formed into a package which includes an external sealing surface and a flap for overlying said sealing surface, said flap having outer and inner surfaces, said sealing surface having separate first and second parts, the flap positionable for its inner surface to overlie said first part of the sealing surface, a label having an inner surface having separate first and second parts, said first part of said label's inner surface attached to said outer surface of said flap, said second part of said label's inner surface positionable to overlie at least a portion of said second part of said sealing surface, said label inner surface and said sealing surface being siliconized, the siliconization of said label inner surface being greater than said siliconization of said sealing surface, and glue adhereable to said label's inner surface and to said sealing surface, said glue adhered initially onto said label's inner surface second part, said label's inner surface second part when positioned to overlie said at least a portion of said second part of said sealing surface having said glue on said label adhere more strongly to said sealing surface, whereby when said flap is pulled off said sealing surface said glue separates from said label and remains adhered to said sealing surface, said label being repeatedly resealable to said sealing surface with said glue remaining on said sealing surface each time said label is pulled off said sealing surface.

2. A re-closable package comprising a wrapper, a first portion of said wrapper formed as a flap, a second portion of said wrapper comprising a sealing surface, a label fixedly adhered to said flap, said label having an application side used for repeatedly overlying said sealing surface and each time detachably sealing said flap to said sealing surface, and a layer of self-adhesive glue interposed between said sealing surface and said application side of said label, wherein said application side of said label and said sealing surface are siliconized, the siliconization of said application side of said label being greater than the siliconization of said sealing surface, and wherein said glue is initially adhered to said application side of said label, whereby when said flap and label overlie said sealing surface said glue on said application side of said label contacts said sealing surface and adheres thereto more strongly than to said application surface from which it becomes detached.

3. A re-closable package of claim 2, wherein said label's application side has an edge region and said label comprises a structurally independent, tongue adhered to said application side in said edge region thereof.

4. A re-closable package of claim 3 wherein said tongue projects from said edge region of said label.

5. A re-closable package comprising a wrapper, a first portion of said wrapper formed as a flap, a second portion of said wrapper comprising a sealing surface, a label fixedly adhered to said flap, said label having an application side for repeatedly and detachably sealing said flap to said sealing surface, and a layer of self-adhesive glue applied to said application side of said label for permanent attachment of said label to said flap and for detachably adhering said label to said sealing surface, wherein said application side of said label and said sealing surface are siliconized, the siliconization of said label being greater than the siliconization of said sealing surface, and wherein said glue is initially adhered to said application side of said label, whereby when said flap and label overlie said sealing surface, said glue on said application side of said label contact's said sealing surface and adheres thereto more strongly than to said application surface from which it becomes detached.

6. A re-closable package according to claim 5 wherein said label includes a region defining an edge which overlies said sealing surface when said package is re-closed, and said label further comprises a tongue secured to said application side of said label in said edge region said tongue not adhering to said sealing surface and thus engagable by a user to pull and detach said label from said sealing surface.

7. A re-closable package according to claim 6 wherein said tongue projects from said edge region.

* * * * *